US005145363A

United States Patent [19]

Nielsen et al.

[11] Patent Number: 5,145,363

[45] Date of Patent: Sep. 8, 1992

[54] METHOD AND AN APPARATUS FOR CONTINUOUSLY PURIFYING AN OXYGEN-CONTAINING GAS FOR COMBUSTIBLE CONTAMINANTS

[75] Inventors: Kai H. Nielsen, Greve Strand; Frands E. Jensen, Ganlose, both of Denmark

[73] Assignee: Haldor Topsoe A/S, Denmark

[21] Appl. No.: 678,951

[22] PCT Filed: Oct. 16, 1989

[86] PCT No.: PCT/DK89/00242

§ 371 Date: Apr. 17, 1991

§ 102(e) Date: Apr. 17, 1991

[87] PCT Pub. No.: WO90/04742

PCT Pub. Date: May 3, 1990

[30] Foreign Application Priority Data

Oct. 17, 1988 [DK] Denmark ..... 5770/88

[51] Int. Cl.[5] ..... F27D 17/00; C03B 5/16

[52] U.S. Cl. ..... 432/180; 432/181; 65/135

[58] Field of Search ..... 432/179-181, 432/223

[56] References Cited

U.S. PATENT DOCUMENTS

| | | | |
|---|---|---|---|
| 3,207,493 | 9/1965 | Swain | 432/180 |
| 4,063,588 | 12/1977 | Thorogood | 165/97 |
| 4,131,155 | 12/1978 | Thorogood | 165/1 |
| 4,424,857 | 1/1984 | Linde | 165/1 |
| 4,528,012 | 7/1985 | Sturgell | 432/181 |
| 4,741,690 | 5/1988 | Heed | 431/7 |
| 4,870,947 | 10/1989 | Kawamoto | 432/181 |
| 4,943,231 | 7/1990 | Jenkins et al. | 432/181 |
| 4,944,670 | 7/1990 | Watson | 432/180 |
| 4,976,611 | 12/1990 | Knop et al. | 432/181 |

FOREIGN PATENT DOCUMENTS

| | | |
|---|---|---|
| 3139153 | 10/1981 | Fed. Rep. of Germany . |
| 86-00389 | 1/1986 | PCT Int'l Appl. . |
| 1478419 | 1/1975 | United Kingdom . |

*Primary Examiner*—Henry C. Yuen

*Attorney, Agent, or Firm*—Ostrolenk, Faber, Gerb & Soffen

[57] ABSTRACT

Combustible impurities in oxygen-containing offgases are burnt according to a method and by an apparatus of the type in which at least some of the heat of combustion is recovered by a regenerative heat exchange in two identical heat exchange zones (10, 11) containing a solid heat exchange material and separated by a combustion chamber (15). The air or gas to be purified flows through both of the heat exchange zones and by means of valves (1, 2, 3, 4). The direction of flow is changed periodically so that the two zones are alternately heated and cooled in periods of 0.1-60 minutes. The risk of discharge of unburnt combustible contaminants to the atmosphere is minimized by dividing the purified gas stream in the first 1-50% of each period into two part streams of which one is discharged directly from the combustion chamber (15) to a recipient (22) whereas the other is passed through the heat exchange zone (10 or 11) being heated and from there recycled through a line (25 or 24) controlled by a valve (7 or 6) and combined with unpurified gas being passed to the heat exchange zone (11 or 10) being cooled.

9 Claims, 3 Drawing Sheets

METHOD AND AN APPARATUS FOR CONTINUOUSLY PURIFYING AN OXYGEN-CONTAINING GAS FOR COMBUSTIBLE CONTAMINANTS

FIELD OF THE INVENTION

The present invention relates to a method for the substantially continuous purification of an oxygen-containing gas containing combustible contaminants by a thermal and/or catalytic combustion process during which at least part of the heat of combustion is recovered by a regenerative heat exchange in two stationary, substantially identical zones comprising solid heat exchange material and separated by a combustion chamber, in which method the air to be purified flows through both of the heat exchange zones and the direction of flow through the zones is reversed periodically such that the two zones are alternately heated and cooled in periods of 0.1 to 60 minutes, preferably 0.5–60 minutes and especially 1–30 minutes.

The invention also relates to an apparatus for carrying out the method according to the invention, provided with a substantially symmetrical reactor having a central combustion chamber with a source of heat and a valve-guided line for discharging the purified gas to a recipient, e.g. a stack; two identical heat exchange layers being placed adjacent or close to the combustion chamber, one at each side thereof, optionally separated therefrom by a catalyst layer; an end chamber being placed adjacent each heat exchange layer at the side thereof farthest from the combustion chamber; said end chambers each being connected to a line provided with valves for admitting untreated gas from a common supply line, and lines provided with valves for discharging the purified gas to the recipient.

Thus, the method and the apparatus according to the invention aim at the catalytic or thermal oxidation of off-gases, notably offgases containing organic solvents from, e.g., offset printing, lacquering and surface finishing while utilizing regenerative heat exchange. Likewise, offgases containing malodorous or harmful substances from organic-chemical syntheses or hardening of polymeric materials and malodorous offgases from the food and feed processing industries, or, e.g., water purification plants may advantageously be purified by the present method.

BRIEF DESCRIPTION OF THE DRAWINGS

The method and the apparatus according to the invention and the technical background thereof is best explained with reference to the drawings. In the drawings

Figure 2:
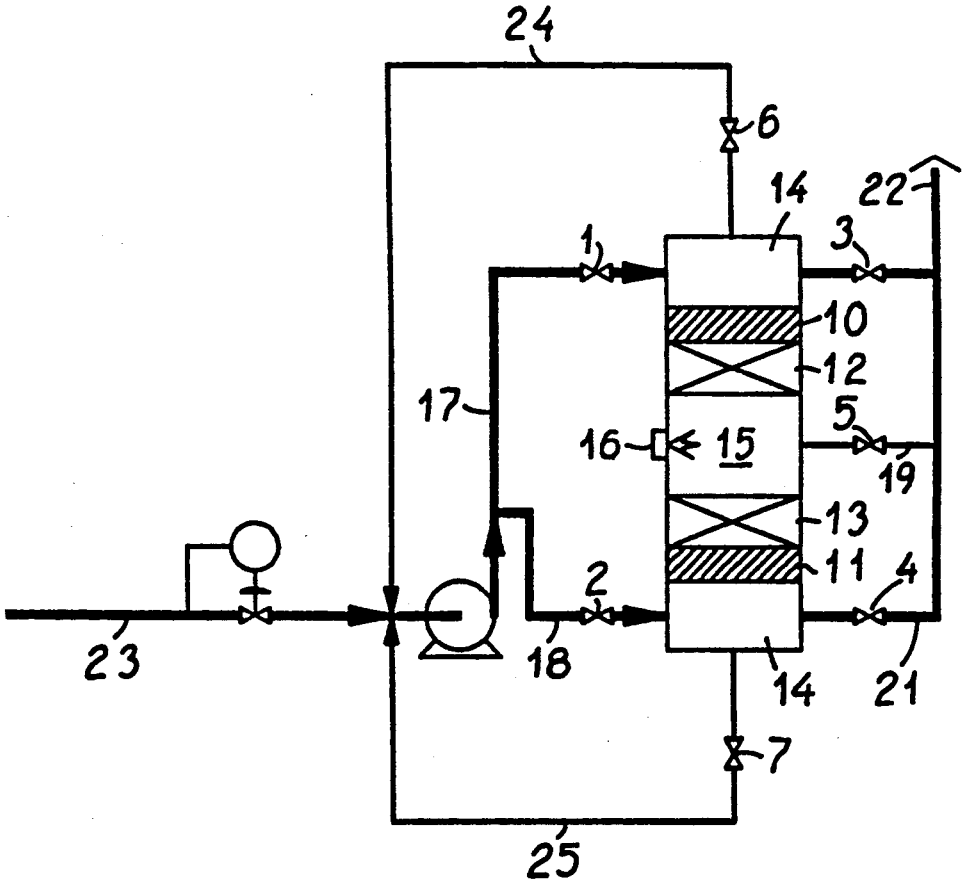
FIGS. 2 and 3 show two different apparatuses for carrying out the method according to the invention.
Figure 3:
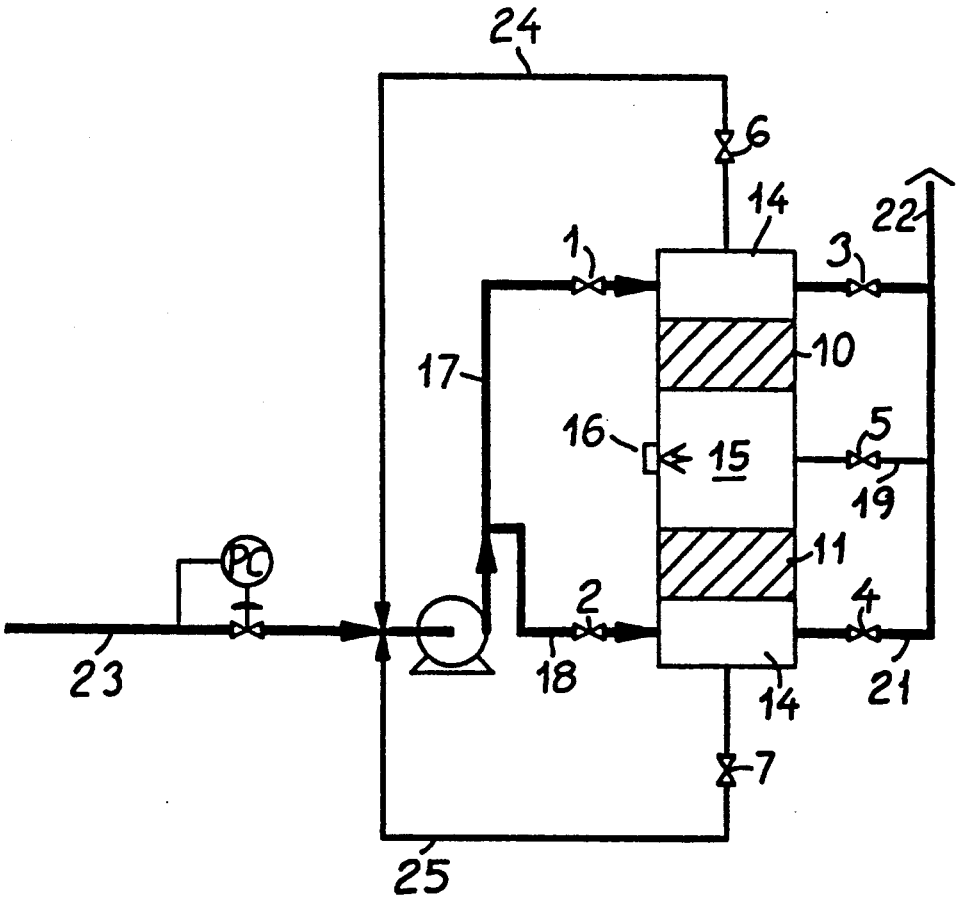

The apparatus shown in FIG. 2 is adapted for catalytic combustion, that in FIG. 3 for thermal combustion.

Identical reference numerals in the various figures denote parts that are identical in principle.

BACKGROUND OF THE INVENTION

Figure 1A:
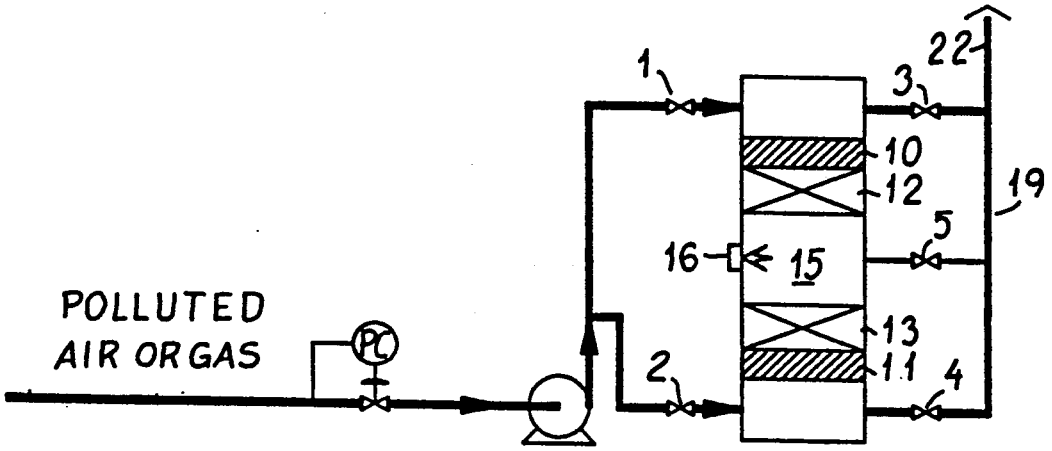
FIGS. 1*a* and 1*b* show two known apparatuses suitable for carrying out the method defined hereinabove.

It is known that offgases as for instance those mentioned may be purified by a catalytical or thermal combustion in which the offgases are heated to temperatures of 200°–450° C. necessary for the catalytical combustion and 700°–1000° C. for the thermal combustion, the heating taking place by a regenerative heat exchange with the hot, purified gases coming from the combustion. The gas is passed through porous layers or blocks of stones, ceramics or metal placed before and after the reaction chamber and the direction of flow is reversed with intervals from ½ minute to an hour depending on, i.a., the relation between the heat capacity of the heat exchange layers and the heat capacity of the gas stream per unit time. FIG. 1*a* shows a known embodiment of an apparatus functioning according to this principle. In a cylindrical vessel, a reactor, there is placed two identical, porous heat exchange layers 10 and 11, e.g. made of ceramic balls, followed by two identical layers 12 and 13 of a combustion catalyst, the two pair of layers being situated adjacent an empty space, functioning as a combution chamber 15 in the middle of the reactor.

A burner or an electric heater 16 is used to start the reactor and to supply heat to the process if the heat of combustion from the combustible components of the gas are not sufficient to maintain the catalyst at the necessary minimum temperature. The direction of flow through the reactor is reversed by keeping valves 1 and 4 open and valves 2 and 3 closed for a period, and thereafter in a subsequent period keeping valves 1 and 4 closed and valves 2 and 3 open. The reference numeral 5 represents a valve for discharging gases directly from space 15 (the combustion chamber) to a stack 22 or other recipient.

It is moreover known, as also shown in FIG. 1*a*, to control the temperature in the combustion zone of the catalyst layer or in combustion chamber 15 by a thermal combustion by discharging a part-stream of the gas directly from this zone away from the apparatus. Thereby the temperature in the combustion zone decreases because the heat content of this part-stream is not utilized for heating the incoming gas. If, for instance, the thermal efficiency is 90%, the contents of combustible components in the gas will give an adiabatic temperature increase of 40° C. at complete combustion and the gas must be heated from an inlet temperature of 100° C., then the temperature in the combustion zone will be 500° C. if hot gas is not discharged from the combustion zone, provided that loss of heat to the surroundings is disregarded. If on the other hand for instance 10% of the hot gas from the combustion zone is conducted away through valve 5, the temperature in the catalyst layers decreases to about 350° C.

Use of this embodiment of the apparatus has the drawback that each time the direction of flow is reversed, e.g. from a descending to an ascending direction of flow, the not purified gas present in the upper heat exchange layer and in the space above that will be led to the discharge gas in a not purified state. This will reduce the average degree of purification corresponding to the volume of this amount of gas relative to the amount of gas flowing through the apparatus during the period until the next reversal of the valves.

Figure 1B:
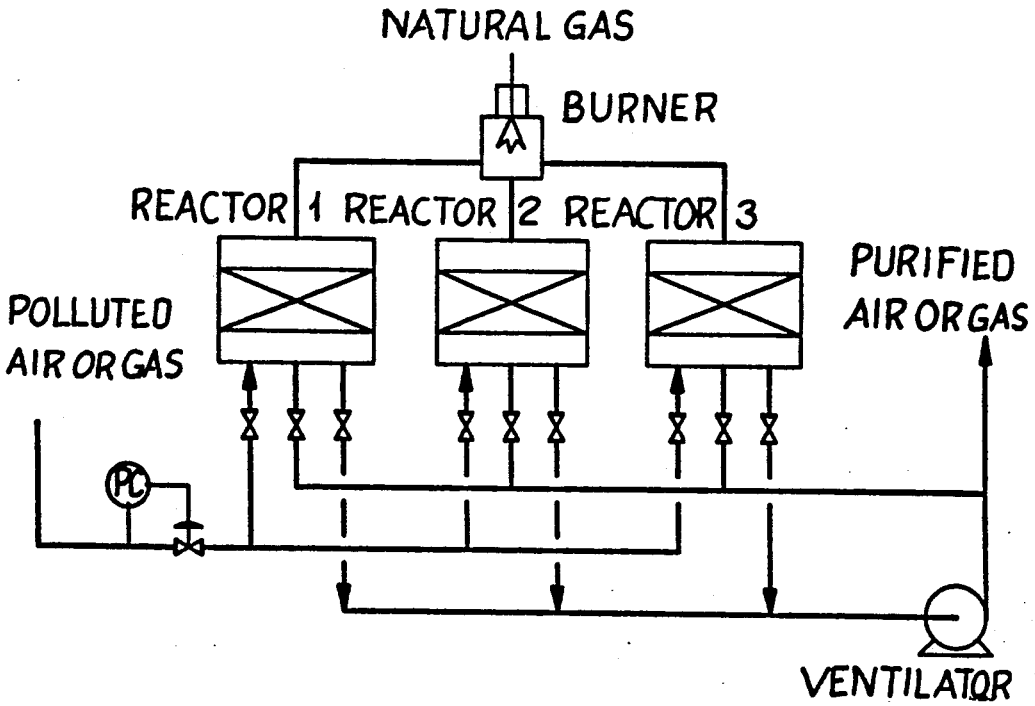

In principle this drawback may be eliminated by the likewise known method that the purification is carried out by means of an apparatus containing several heat exchange layers connected in parallel, which layers for thermal combustion may have a common combustion chamber wherein the combustible components of the gas are burnt. To avoid that uncombusted gas is returned to the purified discharge gas when reversing the direction of flow through a heat exchange layer, an intermediate period is established in which the layer is scavenged with air or purified gas. The latter is recycled to the feed stream of not purified gas before the layer at valve reversal is changed to the period during which hot, not purified gas flows from the combustion zone to the purified discharge gas from the apparatus. In this method it is necessary, in order to carry out the purification without interrupting the flow of gas through the apparatus, that it contains at least three heat exchange layers as shown in FIG. 1*b*, one of these being scavenged and therefore not taking part in the heat exchange between incoming and outgoing gas. To minimize the extra expenditure for layers of heat exchange caused hereby, five heat exchange layers are frequently used of which one will be in the scavending phase whereas four will take part in the heat exchange, two of these being heated by hot, purified gas and the two others being cooled by incoming un-purified gas. On the other hand an increased number of heat exchange layers will involve the drawback that a larger number of valves will be required and that the apparatus becomes more complicated, expensive and bulky.

Document WO-A1-86/00389 describes a method for the substantially continuous purification of an oxygen-containing gas containing combustible contaminants by a thermal and/or catalytic combustion process during which at least part of the heat of combustion is recovered by a regenerative heat exchange in two stationary, substantially identical zones comprising solid heat exchange material and separated by a combustion chamber, in which method the air to be purified flows through both of the heat exchange zones and the direction of flow through the zones is reversed periodically such that the two zones are alternately heated and cooled.

Document WO-A1-86/00389 further describes an apparatus for carrying out the method defined above, provided with a substantially symmetrical reactor having a central combustion chamber with a source of heat, a line provided with a valve for discharging the purified gas to a recipient, two identical heat exchange layers being placed close to the combustion chamber, one at each side thereof, an end chamber being placed adjacent each heat exchange layer at the side thereof farthest from the combustion chamber, said end chambers each being connected with a line provided with a valve for admitting untreated gas from a common supply line and a line provided with a valve for discharging the purified gas to the recipient.

The contents of document WO-A1-86/00389 are briefly stated in the first portions (preambles) of claims 1 and 7 as presented in the last part of the present specification.

BRIEF DESCRIPTION OF THE INVENTION

The method of the present invention differs from the disclosure of document WO-A1-86/00389 in that the purified gas stream in the first 1% to 50% of each period is divided into two part-streams of which one is passed directly from the combustion chamber to a recipient and the other is passed through the heat exchange zone being heated and from there is recycled and combined with the untreated gas stream which is conducted to the heat exchange zone being cooled.

The apparatus according to the present invention differs from the one defined in document WO-A1-86/00389 in that a recycle line provided with a valve leads from each end chamber to the common supply line.

The difference between the apparatus and the method of the application and prior art allows a significant reduction in the level of unburnt matter in the purified offgas.

DETAILED DESCRIPTION OF THE INVENTION

The disadvantages in the known methods for scavenging the heat exchange layer and the space at its cold side are avoided by the embodiment of the apparatus shown in FIG. 2 whereby substantially the same simplicity, compactness and full utilization of the entire capacity of the heat exchange layers is obtained as in the apparatus shown in FIG. 1*a*; and at the same time that the degree of purification becomes high and the purification of the gas stream to purify takes place continuously and can be conducted without any interruptions.

In the arrangement of the apparatus according to the invention shown in FIG. 3 the combustion is thermal and takes place in space 15 opposite the gas discharge to valve 5 instead of in the abovementioned two layers of combustion catalyst; the heat exchange layer and the space at the cold side thereof may be scavenged in the same manner while obtaining the same advantages.

Besides the reference numerals already identified in connection with the description of FIG. 1*a*, further reference numerals in FIGS. 2 and 3 have meanings as follows:

Polluted air or gas is passed to the apparatus via a common supply line 23 via a pump after which line 23 is divided into two lines 17 and 18 supplied with valves 1 and 2, enabling the polluted feed gas to be directed alternately to an upper or a lower end chamber 14. The upper and lower end chambers communicate with discharge lines 20 and 21, respectively, provided with valves 3 and 4. Below it is described how valves 1, 2, 3 and 4 are operated.

The essential feature of the apparatus according to the present invention is two recycle lines 24 and 25, provided with valves 6 and 7, respectively, which is in contradistinction to the apparatus shown in FIG. 1*a*. Through these recycle lines gas not purified can be recycled from end chambers 14 above and below either of the two heat exchange layers to enter the common supply line (feed line) 23. At the same time the apparatus according to the invention is operated in such a manner that the amount of hot, purified gas which is discharged via valve 5 (in order to maintain a necessary minimum temperature between the two catalyst layers, e.g., 350° C.) is not carried away by the discharge of a constant porportion (for instance 10%) of the gas stream through the apparatus. Instead the total stream of gas to be purified is passed to discharge line 20 or 21 during a part of, e.g., 5% of the length of each period; and simultaneously the heat exchange layer 10 or 11 is caused to shift from a period with incoming un-purifed feed gas to a period where outgoing purified gas is scavenged with an additional stream of air comprising, e.g., 10% of the gas stream to be purified. This additional stream of air is recycled through the apparatus and is discharged from the end chamber 14 above (or below) that heat exchange layer 10 (or 11) via the recycle line 24 (or 25) belonging thereto. In practice the reversal of the valves takes place in the following sequence of time (where O stands for open and C for closed):

| Valve No. | 1 | 2 | 3 | 4 | 5 | 6 | 7 |
|---|---|---|---|---|---|---|---|
| Phase 1, gas descending | O | C | C | O | C | C | C |
| Phase 2, scavenging upper layer | C | O | C | C | O | O | C |
| Phase 3, gas ascending | C | O | O | C | C | C | C |
| Phase 4, scavenging lower layer | O | C | C | C | O | C | O |
| Phase 1, gas descending | O | C | C | O | C | C | C |

The above diagram represent an idealized situation. In cases of high amounts of combustibles in the gas to be purified, it may be necessary to keep the temperature at tolerable levels by discharging gas more or less continually through valve 5.

EXAMPLE

The method was tested in a pilot apparatus for the purification of 100 $Nm^3/g$ offgas containing 0.5–5 g of acetone per $Nm^3$ and having a temperature before entering the apparatus of 50° C. The apparatus is constructed as shown in FIG. 2. The reactor has an inner diameter of 310 mm and is insulated with 200 mm mineral wool. The reactor contains 56 kg of heat exchange material in the form of ceramic balls having a diameter of 3–5 mm, and 22 kg of combustion catalyst in the form of balls having a diameter of 2–5 mm. Both the heat exchange layer and the catalyst have been divided into two layers of the same size, symmetrically placed adjacent space 15 and the discharge line to valve 5 as shown in FIG. 2.

When operating the apparatus without scavenging, i.e. according to the known method without using valves 6 and 7 and only utilizing phases 1 and 3 as shown in the diagram above, valves 4 and 3, respectively, are open. Furthermore there is continually discharged such an amount of gas (denoted G5 $Nm^3/h$ in Table 1 below) through valve 5, that the temperature in the catalyst layer is maintained constant at 350°–400° C. This is a temperature sufficiently high to ensure a concentration below 1–2 mg $C/Nm^3$ in the gas discharged via valve 5. C here denotes organically combined carbon in the gas and is measured by flame ionizing analysis. The column headed t1 shows the time elapsed between the valve readjustments reversing the direction of flow through the apparatus. X1 is the content of acetone in the feed gas, expressed in $g/Nm^3$ and X2 is the average content of organically combined carbon in the total stream of purified gas leaving the apparatus. The results are shown in Table 1.

TABLE 1

| Test No. | X1 g acetone/$Nm^3$ | t1 minutes | G5 $Nm^3/h$ | X2 mg $C/Nm^3$ |
|---|---|---|---|---|
| 11 | 0.5 | 3 | 0 | 40 |
| 12 | 0.5 | 6 | 0 | 25 |
| 13 | 2 | 3 | 15 | 150 |
| 14 | 5 | 3 | 30 | 300 |
| 15 | 5 | 6 | 25 | 200 |

When operating the same apparatus according to the method of the invention the results shown in Table 2 were obtained. Here, t1 is the time (minutes) in each of phases 1 and 3 between valve readjustments and t2 is the time (minutes) in each of phases 2 and 4 between valve adjustments:

TABLE 2

| Test No. | X1 g acetone/$Nm^3$ | t1 minutes | t2 minutes | X2 mg $C/Nm^3$ |
|---|---|---|---|---|
| 21 | 0.5 | 3 | 0.1 | 20 |

TABLE 2-continued

| Test No. | X1 g acetone/$Nm^3$ | t1 minutes | t2 minutes | X2 mg $C/Nm^3$ |
|---|---|---|---|---|
| 22 | 0.5 | 6 | 0.2 | 10 |
| 23 | 2 | 3 | 0.5 | 15 |
| 24 | 2 | 6 | 0.8 | 8 |
| 25 | 5 | 3 | 1 | 8 |
| 26 | 5 | 6 | 1.8 | 6 |

It is realized directly from Table 2 that the scavenging procedure according to the invention causes a strong reduction of the contents of remaining unburnt components in the purified offgas, especially in case of high concentrations in the feed gas. In test No. 22 though, it was necessary to supply additional heat to space 15 by means of the burner in order to maintain a temperature of 350° C. in the catalyst.

The time it takes to readjust the four valves to reverse the direction of flow in the above apparatus is below 1 second and does not cause any appreciable throughput of unburnt acetone. In apparatuses for larger amounts of gas, valves are needed which have a larger diameter and longer time for the readjustment, whereby the use of the method of the invention will be still more advantageous.

INDUSTRIAL UTILIZATION OF THE INVENTION

It is expected that the method and the apparatus according to the invention will be useful in factories producing big amount of offgases polluted with organic compounds, especially organic solvents from, e.g., surface finishing, printing establishments and lacquering; and in purifying malodorous and/or harmful gaseous substances, e.g. from organic syntheses, plastics industries, water purification or food or feed industries.

We claim:

1. In a method for the substantially continuous purification of an oxygen-containing gas containing combustible contaminants by thermal and/or catalytic combustion in a combustion zone situated between two stationary substantial identical heat exchange zones containing solid heat exchange material during which at least part of the heat of combustion is recovered by regenerative heat exchange in said heat exchange zones, in which method the gas to be purified flows through both heat exchange zones and the direction of flow through said heat exchange zones is reversed periodically such that the two zones are alternately heated and cooled in periods of 0.1 to 60 minutes, the improvement comprising dividing the purified gas stream in the first 1% to 50% of each period into two portions, passing one portion directly from the combustion chamber to a recipient and passing the other portion through the heat exchange zone being heated and recycling it by combining it with the untreated gas being conducted to the heat exchange zone being cooled.

2. A method as claimed in claim 1, wherein said combustion zone contains two substantially identical layers of a combustion catalyst, each said layer being contiguous to a heat exchange zone.

3. A method as claimed in claim 1, wherein said contaminated gas is diluted with air if it contains more than 15 g of combustible substances per $Nm^3$.

4. A method as claimed in claim 1 wherein the stream portion withdrawn directly from the combustion chamber is larger than the recycled stream portion.

5. A method as claimed in claim 1, wherein the length of the periods is 1–30 minutes.

6. A method as claimed in claim 2, wherein the stream portion withdrawn directly from the combustion chamber is larger than the recycled stream portion.

7. A method as claimed in claim 3, wherein the portion withdrawn directly from the combustion chamber is larger than the stream portion.

8. An apparatus for the substantially continuous purification of an oxygen-containing gas containing combustible contaminants, said apparatus comprising:

a substantially symmetrical reactor having a central combustion chamber (15) provided with a source of heat (16) and a line (19) provided with a valve (5) for discharging the purified gas to recipient means (22), two identical heat exchange layers (10,11) positioned close to the combustion chamber (15), one at each side thereof, an end chamber (14) positioned adjacent each said heat exchange layer (10,11) at the side thereof farthest from the combustion chamber (15), said end chambers being connected with lines (17,18) provided with valves (1,2) for admitting untreated gas from a common supply line (23) and lines (20,21) provided with valves (3,4) for discharging the purified gas to said recipient means (22), and a recycle line (24,25) provided with a valve (6,7) leading from each end chamber (14) to said common supply line.

9. An apparatus as claimed in claim 8, wherein a catalyst layer (12,13) is positioned in extension of either heat exchange layer (10,11), at the side thereof adjacent the combustion chamber (15).

* * * * *